United States Patent [19]

Musschoot

[11] Patent Number: 4,906,356

[45] Date of Patent: Mar. 6, 1990

[54] MATERIAL CLASSIFYING APPARATUS

[75] Inventor: Albert Musschoot, Barrington, Ill.

[73] Assignee: General Kinematics Corporation, Barrington, Ill.

[21] Appl. No.: 251,298

[22] Filed: Sep. 30, 1988

[51] Int. Cl.[4] ..... B07B 1/46

[52] U.S. Cl. ..... 209/261; 209/254; 209/315; 209/332

[58] Field of Search ..... 209/311, 315, 331, 332, 209/335, 365.1, 366, 366.5, 362, 254, 255, 261

[56] References Cited

U.S. PATENT DOCUMENTS

| | | | |
|---|---|---|---|
| 671,347 | 4/1901 | Malsness | 209/332 |
| 3,217,561 | 11/1965 | Allgaier | 209/332 X |
| 3,501,002 | 3/1970 | Talley, Jr. | 209/240 |
| 3,539,008 | 11/1970 | McKibben | 209/234 |
| 3,743,094 | 7/1973 | Mook | 210/78 |
| 3,773,661 | 11/1973 | Talley | 210/19 |
| 3,841,482 | 10/1974 | Barrows et al. | 209/323 |
| 3,899,414 | 8/1975 | Hansen | 209/254 X |
| 3,915,775 | 10/1975 | Davis | 209/403 X |
| 4,234,416 | 11/1980 | Lower et al. | 209/315 X |
| 4,679,708 | 7/1987 | Spence | 222/161 |
| 4,685,504 | 8/1987 | Bond et al. | 164/203 |

FOREIGN PATENT DOCUMENTS

| | | | |
|---|---|---|---|
| 74382 | 8/1893 | Fed. Rep. of Germany | 209/332 |
| 642022 | 1/1979 | U.S.S.R. | 209/332 |
| 10053 | of 1889 | United Kingdom | 209/332 |
| 30163 | of 1897 | United Kingdom | 209/332 |

*Primary Examiner*—Donald T. Hajec

*Attorney, Agent, or Firm*—Wood, Dalton, Phillips, Mason & Rowe

[57] ABSTRACT

A material classifying apparatus for separating material into at least overs and fines. The apparatus includes a material receiving housing supporting one or more vertically spaced separator screens. When more than one separator screen is used, the lowermost one of the screens has a finer mesh than the uppermost one of the screens. The apparatus will then further include a discharge opening associated with the periphery of the uppermost one of the screens for discharging overs from the material receiving housing, a discharge opening associated with the periphery of the lowermost one of the screens for discharging product from the material receiving housing, and a discharge opening disposed below the lowermost one of the screens for discharging fines from the material receiving housing. Whether one or more separator screens are used, the screens will have portions such that in combination with a vibration generator material is moved in an outwardly expanding spiral path toward the respective discharge openings. The apparatus thus further includes a vibration generator mounted on the material receiving housing to cause material to move in the outwardly expanding spiral paths. Preferably, the material receiving housing is resiliently supported on a base.

18 Claims, 2 Drawing Sheets

MATERIAL CLASSIFYING APPARATUS

FIELD OF THE INVENTION

The present invention generally relates to a material classifying apparatus and, more particularly, to a structure for moving material in a spiral path for separating material into at least overs and fines.

BACKGROUND OF THE INVENTION

There are many industrial applications utilizing one or more sized granular materials. One particularly noteworthy application is a foundry which performs the process of casting metals, e.g., by making sand castings. In casting processes, a mold is made by packing molding sand around a pattern.

Molding sand consists of silica grains held together by some bonding material such as clay or bentonite. Grain size greatly influences the surface finish of a casting with the proper grain size being determined by the size of the casting, the quality of surface required, and the surface tension of the molten metal. When maximum permeability is desired, the grain size should be approximately uniform.

For this purpose, it is important for the sand to be classified, i.e., to have a known, uniform grain size. This has typically been done by utilizing a material classifying apparatus involving one or more separator screens where the sand travels a considerable straight-line distance over the screen to complete the separation. If the sand does not traverse a given distance, it has been found that the separation is incomplete and the grain size of the sand is not uniform.

Because of this requirement, most material classifying apparatus have occupied considerable space. The mere length of the path of travel required to assure complete separation has required such devices to be very large in size which not only occupies an undo amount of plant space but also has involved considerable capital expenditures to purchase and maintain the necessary equipment. Moreover, with regard to attempts to overcome such problems, it is known that another factor must be properly considered Namely, if the sand is to proceed in other than a straight line, i.e., a longitudinal path, the separator screen or screens must be mounted under tension in a precise manner. It is essential that the screen or screens not be distorted in any manner which would disturb the mesh size thereof at any point in the path of travel to avoid non-uniform grain size in the sand that will be used in the casting process. In other words, it is known to be important to apply uniform tension to the separator screens.

While the discussion has focused on a foundry application, it will be appreciated that the same problems exist wherever a granular material must be of uniform grain size. This could encompass a wide variety of industrial applications, ranging from the foundry process described to, e.g., the confection industry. Accordingly, the problem in handling sand in a foundry is presented as merely representative.

The present invention is directed to overcoming the above stated problems and accomplishing the stated objects by providing a unique material classifying apparatus.

SUMMARY OF THE INVENTION

Accordingly, the present invention is used in a material classifying apparatus for separating material into at least overs and fines. The apparatus in which the invention is used includes a material receiving housing supporting one or more vertically spaced separator screens. When more than one separator screen is used, the lowermost one of the screens has a finer mesh than the uppermost one of the screens.

Further, the apparatus preferably includes means associated with the periphery of the uppermost one of the screens for discharging overs from the material receiving housing, means associated with the lowermost one of the screens for discharging product from the material receiving housing, and means disposed below the lowermost one of the screens for discharging fines from the material receiving housing.

The invention is directed to vibrating the housing separator screen or screens so as to move material in an outwardly expanding spiral path toward respective overs and product discharge chutes. The apparatus includes structure for uniformly tensioning the separator screen and sloping opposite halves of the screen such that vibratory motion of the housing and screen will give the material a force component that will cause the material to move in the outwardly expanding spiral path. The material classifying apparatus includes a variable force vibrator adjustably mounted on the housing which in turn is resiliently supported on a base.

In the preferred embodiment, the material receiving housing is generally square shaped and has one or more screens. The screen is also preferably generally square shaped and is supported intermediate opposing sides to define a centrally disposed elongated ridge. The screen is preferably formed such that the centrally disposed elongated ridge and opposing sides are generally parallel. With this arrangement, the screen can advantageously be secured to the material receiving housing under substantially uniform tension entirely about the periphery thereof.

Moreover, one or more of the screens are arranged so as to be vibrated to give the material a force component on the sloping screens that will move material in an outwardly expanding spiral path up and over the elongated ridge with the overs and/or product on the screen approaching the discharge chute for that screen.

In one embodiment, the overs discharge chute and product discharge chute are supported by the material receiving housing. The discharge chutes are preferably disposed on opposite sides of the material receiving housing adjacent one of the opposing sides of each of the screens. Further, the fines discharging means is preferably a centrally disposed discharge chute supported by the material receiving housing below the lowermost one of the separator screens.

Additionally, the vibrating means preferably includes a pair of variable force angularly adjustable vibration generators mounted in equal and opposite angular relation on the material receiving housing. Preferably, the vibration generators are adjustable to vary the rate the overs and product are moved along the respective spiral paths toward the respective ones of the discharge chutes.

Still other objects, advantages and features of the invention will be apparent from the following specification taken in conjunction with the accompanying drawings.

DETAILED DESCRIPTION OF THE PREFERRED EMBODIMENT

Figure 1:
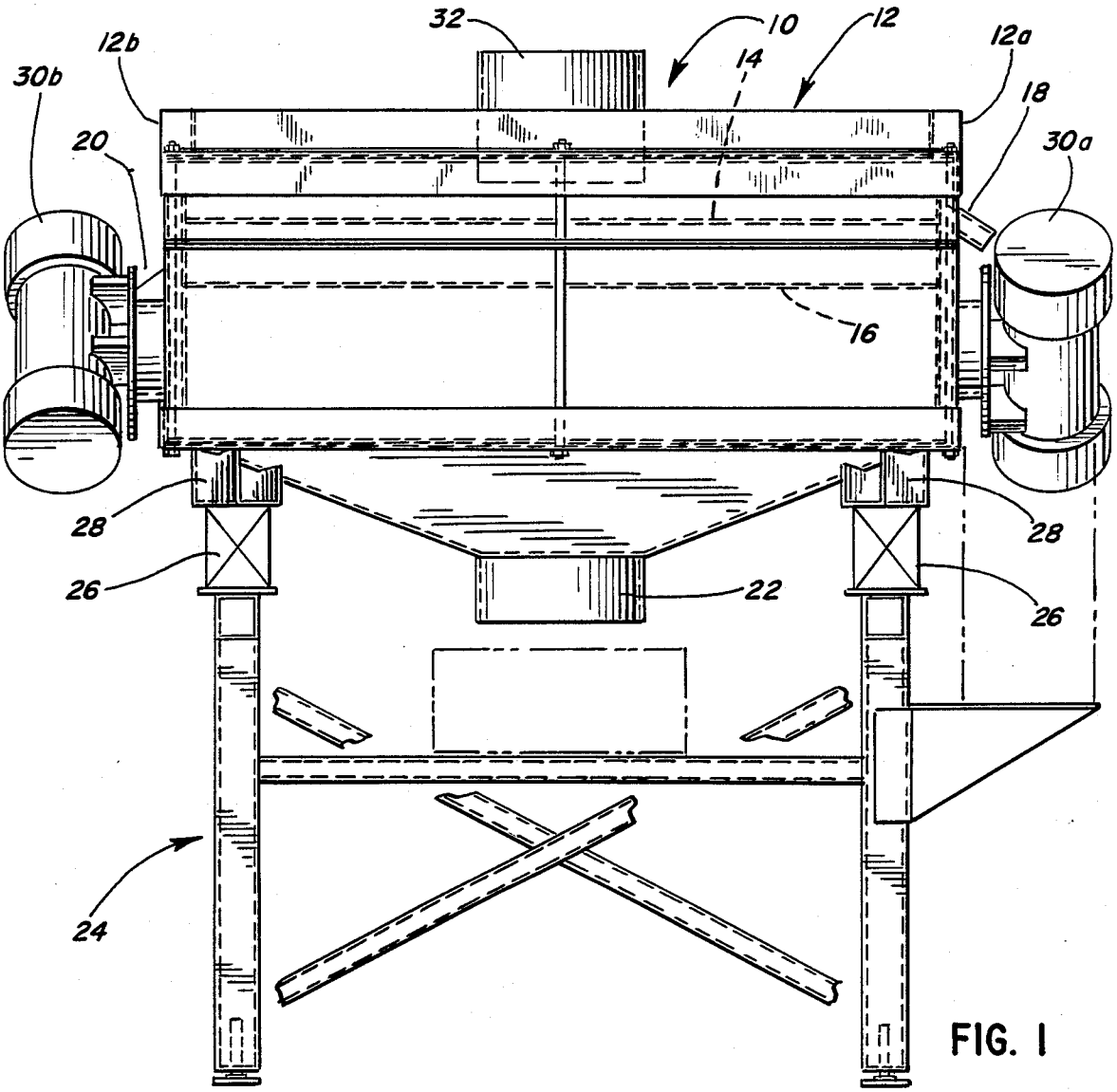
FIG. 1 is a front elevational view of a material classifying apparatus in accordance with the present invention.

Referring to the drawings, reference number 10 designates generally a material classifying apparatus for separating material into overs, products and fines. The material classifying apparatus 10 includes a material receiving housing 12 supporting a pair of vertically spaced separator screens 14 and 16. The separator screens 14 and 16 are formed such that a lowermost one of the screens 16 has a finer mesh than an uppermost one of the screens 14. The material classifying apparatus 10 also includes means such as a discharge chute 18 associated with the periphery of the uppermost one of the screens 14 for discharging the overs from the material receiving housing 12. It will also be seen that the material classifying apparatus 10 includes means such as a discharge chute 20 associated with the periphery of the lowermost one of the screens 16 for discharging the product from the material receiving housing 12. The material classifying apparatus 10 further includes means such as a centrally disposed discharge chute 22 positioned below the lowermost one of the screens 14 for discharging the fines from the material receiving housing 12. The separator screens 14 and 16 are both arranged so that when vibrated a force component will be given to the particles of material in the sloping screen halves to give the particles of the material an outwardly expanding spiral path toward the overs discharge chute 18 and the product discharge chute 20. For this purpose, the material classifying apparatus 10 includes means for vibrating the material receiving housing 12 to move the material in the outwardly expanding spiral path as will be described in greater detail hereinafter.

While two screens 14 and 16 are illustrated and described, it is to be understood that one or more screens can be employed, the invention being directed to the spiral path of movement of particles of material on the screen or screens.

Figure 2:
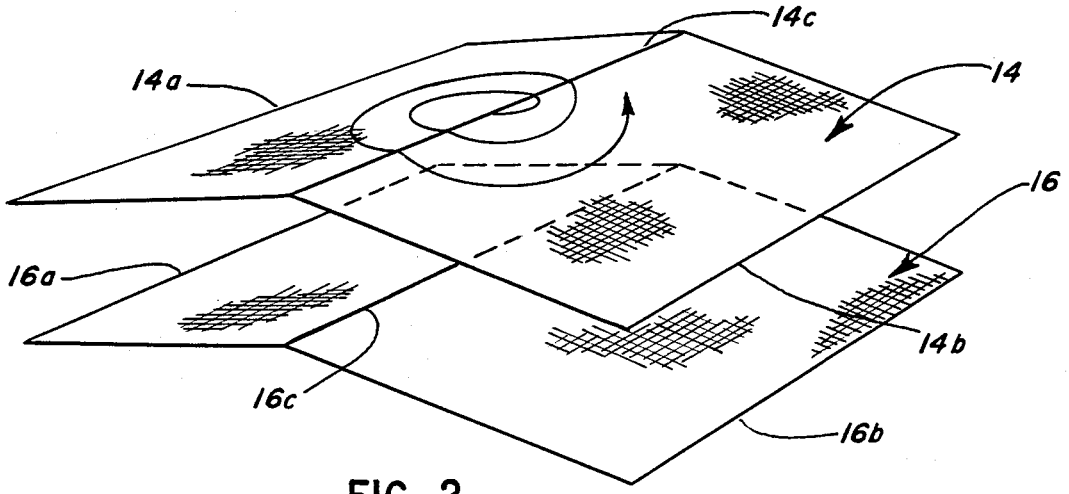
FIG. 2 is a perspective view illustrating an outwardly expanding spiral path of movement for material in the material classifying apparatus.
Figure 3:
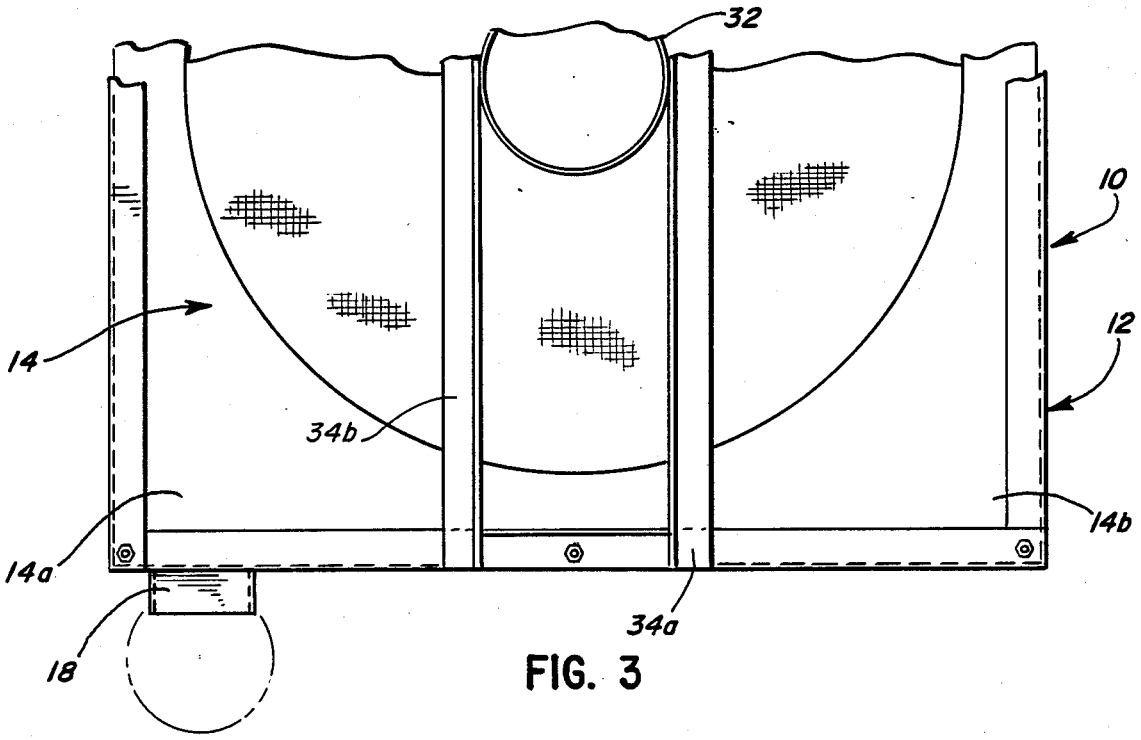
FIG. 3 is a top plan view of the material classifying apparatus.

As will be appreciated by referring to FIG. 3, the material receiving housing 12 is generally square shaped and each of the separator screens 14 and 16 are also generally square shaped. It will be seen in exaggerated form in FIG. 2, however, and also appreciated by referring to FIG. 4, that each of the separator screens 14 and 16 (where two are used) is supported intermediate opposing sides 14*a*, 14*b* and 16*a*, 16*b*, respectively, to define respective centrally disposed elongated ridges 14*c* and 16*c*. As shown, the centrally disposed elongated ridges 14*c* and 16*c* and the corresponding opposing sides 14*a*, 14*b* and 16*a*, 16*b*, respectively, of each of the separator screens 14 and 16 are disposed so as to lie generally parallel.

Referring to FIG. 1, the overs discharge chute 18 and product discharge chute 20 are supported by the material receiving housing 12. These discharge chutes 18 and 20 are also disposed in diagonally opposite corners on opposite sides 12*a* and 12*b* of the material receiving housing 12 adjacent to one of the opposing sides, e.g., 14*a* and 16*b*, respectively, of each of the separator screens 14 and 16. As will be appreciated from either FIG. 1 or FIG. 4, the fines discharge chute 22 is also supported by the material receiving housing 12 but at a position below the lowermost one of the separator screens 16.

As shown, the material receiving housing 12 is preferably resiliently supported on a base generally designated 24. The resilient support may be accomplished by means of a plurality of marshmallow springs 26 disposed between spring seats 28 on the bottom of the material receiving housing 12 and a tubular frame structure defining the base 24. Preferably, the marshmallow springs 26 are positioned at each of the four corners of the material receiving housing 12.

As previously suggested, the vibrating means preferably includes a pair of vibration generators 30*a* and 30*b* mounted in equal and opposite angular relation on opposite sides 12*a* and 12*b* of the material receiving housing 12. The vibration generators are of the variable force type such as shown in my U.S. Pat. No. 4,495,826 wherein the vibratory forces can be varied by remote control during operation of the apparatus. Each vibration generator 30*a*, 30*b* can be angularly adjusted relative to the housing 12. By adjusting the vibratory forces and the angular relationship of the vibration generators, the path of the particles on the screens can be varied. The resultant vibratory forces delivered to the housing and, therefore, to the screens and particles, includes a force component which when combined with the sloping halves of the screens rolls the particles at the same time they are given an angular tossing type throw. The just described vibratory forces cause the particles to climb one upward sloping side of the screen, cross over the ridge 14*c*, 16*c* and continue in the spiral path down and across the other downward sloping side. As the particles roll and toss in the spiral path along the screen surface, the undersized particles for the particular screen drop through. The same motion is then afforded to the fallen through particles on the lower screen. The uppermost one of the screens 14 is arranged so as to repeatedly move material in an outwardly expanding spiral path up and over the elongated ridge 14*c* so as to approach the overs discharge chute 18 when the material receiving housing 12 is vibrated. This unique aspect of the present invention is illustrated in FIG. 2. The lowermost one of the screens 16 is similarly arranged so as to repeatedly move material in an outwardly expanding spiral path up and over the elongated ridge 16*c* so as to approach the product discharge chute 20 when the material receiving housing 12 is vibrated. Preferably, the vibration generators 30*a* and 30*b* are adjustable to vary the rate the overs and product are moved along the spiral paths toward the respective one of the discharge chutes 18 and 20. Using the improved structure, a two or three foot square apparatus can handle the equivalent classifying requirements of a twenty or thirty foot straight line classifier.

Figure 4:
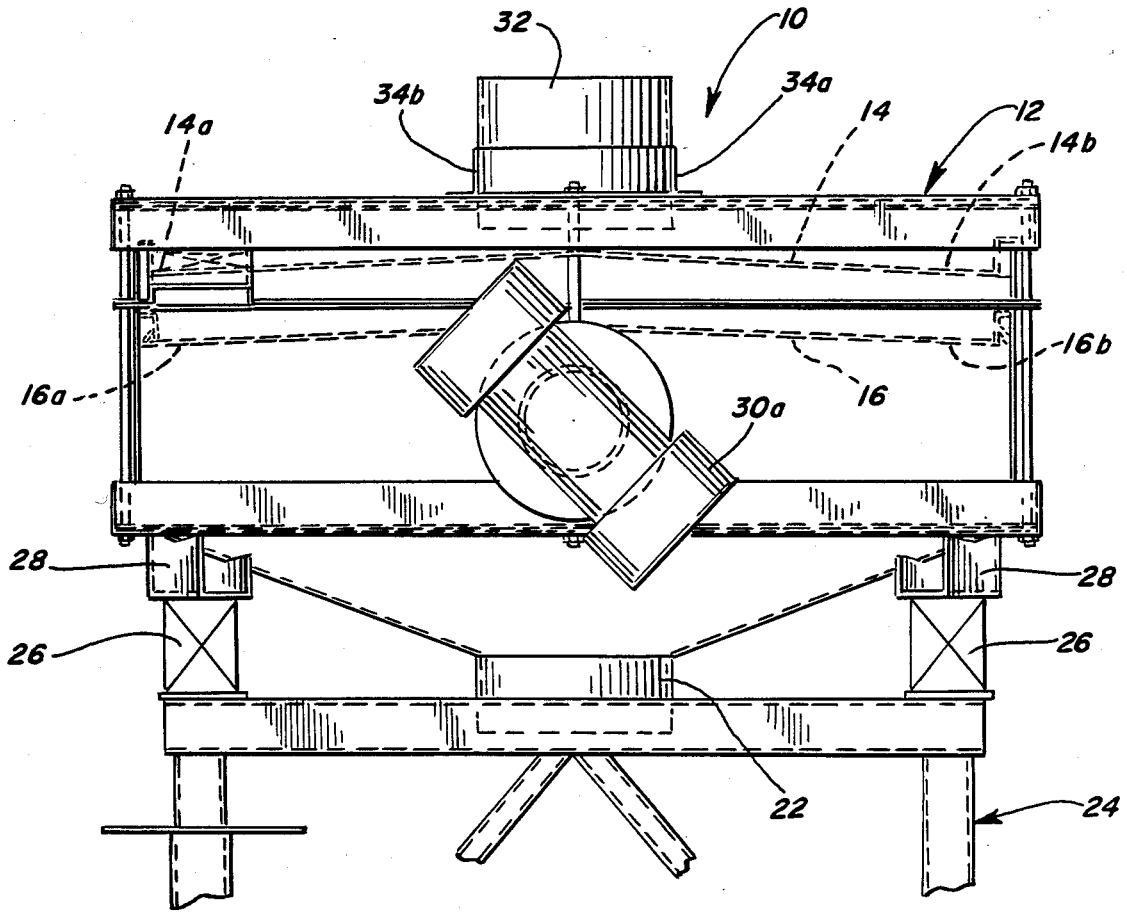
FIG. 4 is a side elevational view of the material classifying apparatus in accordance with the present invention.

As shown in the drawings, the material classifying apparatus 10 also preferably includes a centrally disposed delivery chute 32 which may be supported by parallel, longitudinally extending angle brackets 34*a* and 34*b* (see FIGS. 1 and 4). Thus, a material such as sand can be centrally deposited on the uppermost one of the separator screens 14 to begin the path of travel illustrated in FIG. 2. In addition, each of the screens 14 and 16 is secured to the material receiving housing 12 under substantially uniform tension entirely about the periphery thereof.

In this connection, uniform tension can be applied because of the fact that the separator screens 14 and 16 need be gripped and tensioned along straight sides and then supported evenly only at opposite sides and centrally on the housing as illustrated in FIG. 4. It will, of course, be understood and appreciated that support structure as at 36 will be utilized to form the centrally disposed elongated ridges 14*c* and 16*c* but, by reason of the central elevation of the respective screens 14 and 16 entirely thereacross and generally parallel to the respective opposing sides 14*a*, 14*b* and 16*a*, 16*b*, the tension will be substantially uniform. As a result, there will be no distortion of the mesh of the respective screens 14 and 16 that might otherwise cause the material to be classified in a non-uniform manner.

In addition, the mesh of the respective screens 14 and 16 may be selected to precisely control the grain size of the product obtained through the product discharge chute 20. In other words, any material other than that of the desired grain size or less will be retained on the uppermost one of the screens 14 and, upon completing the outwardly expanding spiral path, will pass through the overs chute 18 while the mesh of the lowermost one of the screens 16 will be sufficiently small so as to retain material of the desired grain size which, upon completing its outwardly expanding spiral path, will pass through the product discharge chute 20. As will be appreciated, smaller granular materials, or fines, will pass through the lowermost one of the screens 16 for removal from the material receiving housing 12 through the fines discharge chute 22.

In operation, it will be appreciated that the material classifying apparatus 10 is very compact while accommodating the requirement of a lengthy path of travel for the material by reason of the outwardly expanding spiral path. The outwardly expanding spiral path is achieved while at the same time ensuring substantially uniform tension to maintain the integrity of the mesh size of the respective screens 14 and 16 by forming the respective elongated ridges 14*c* and 16*c*. Accordingly, the present invention successfully provides a material classifying apparatus capable of very precise separation of materials according to grain size.

While in the foregoing there has been set forth a preferred embodiment of the invention, it will be understood that the details herein given are for purposes of illustration only and the invention is to be limited solely by the spirit and scope of the appended claims.

I claim:

1. A material classifying apparatus for separating material into overs and fines, comprising:

a material receiving housing supporting a separator screen;

means disposed above the screen for centrally depositing material onto the screen;

means associated with the screen for discharging overs from the screen;

means disposed below the screen for discharging fines that pass through the screen;

means for vibrating the material receiving housing and the screen, the vibrating means imparting a force component to particles of the material on the screen; and means for angularly mounting a portion of the screen relative to the remainder of the screen to provide two opposite angled portions such that the force component from the vibrating means is sufficient alone to provide an outwardly expanding spiral path to particles of the material on the screen as the material traverses the angled portions of the screen.

2. The material classifying apparatus as defined in claim 1 wherein the material receiving housing is generally square shaped.

3. The material classifying apparatus as defined in claim 1 wherein the screen is generally square shaped and has opposing sides.

4. The material classifying apparatus as defined in claim 3 wherein the means for angularly mounting a portion of the screen comprises means intermediate the opposing sides, to define a centrally disposed elongated ridge, the ridge dividing the screen into said two opposite angled portions.

5. The material classifying apparatus as defined in claim 4 wherein the ridge and the opposing sides of the screen are generally parallel.

6. The material classifying apparatus as defined in claim 1 wherein the fines discharging means is a centrally disposed discharge chute supported by the material receiving housing below the screen.

7. The material classifying apparatus as defined in claim 1 wherein the vibrating means includes a pair of vibration generators mounted in equal and opposite angular relation on the material receiving housing.

8. A material classifying apparatus for separating material into overs, product and fines, comprising:

a material receiving housing supporting a pair of vertically spaced separator screens, a lowermost one of the screens having a finer mesh than an uppermost one of the screens, the material receiving housing being generally square shaped;

means disposed above the uppermost one of the screens for centrally depositing material onto the uppermost one of the screens;

means associated with the periphery of the uppermost one of the screens for discharging the overs from the material receiving housing;

means associated with the periphery of the lowermost one of the screens for discharging the product from the material receiving housing;

means disposed below the lowermost one of the screens for discharging the fines from said material receiving housing; and means for vibrating the material receiving housing and the screens;

each of the screens being generally square shaped and having opposing sides, the screens being supported intermediate the opposing sides to define a centrally disposed elongated ridge, the ridge dividing each of the screens into two oppositely angled portions, the uppermost one of the screens being supported relative to the horizontal such that a force component from the vibrating means provides an outwardly expanding spiral path to particles of the material up and over the elongated ridge as the material traverses the screen so as to approach the overs discharging means;

the lowermost one of the screens being supported relative to the horizontal such that a force component from the vibrating means provides an outwardly expanding spiral path to particles of the material up and over the elongated ridge as the material traverses the screen so as to approach the product discharging means.

9. The material classifying apparatus as defined in claim 8 wherein the overs discharging means and the product discharging means are discharge chutes supported by the material receiving housing.

10. The material classifying apparatus as defined in claim 9 wherein the discharge chutes are disposed on opposite sides of the material receiving housing adjacent one of the opposing sides of each of the screens.

11. The material classifying apparatus as defined in claim 8 wherein the fines discharging means is a centrally disposed discharge chute supported by the material receiving housing below the lowermost one of the screens.

12. The material classifying apparatus as defined in claim 8 wherein the vibrating means includes a pair of vibration generators mounted in equal and opposite angular relation on the material receiving housing.

13. A material classifying apparatus for separating material into overs, product and fines, comprising:

a material receiving housing resiliently supported on a base, the material receiving housing supporting a pair of vertically spaced separator screens including a lowermost one of the screens having a finer mesh than an uppermost one of the screens, the material receiving housing being generally square shaped;

means disposed above the uppermost one of the screens for centrally depositing material onto the uppermost one of the screens;

means associated with the periphery of the uppermost one of the screens for discharging the overs from said material receiving housing;

means associated with the periphery of the lowermost one of the screens for discharging the product from the material receiving housing;

means disposed below the lowermost one of the screens for discharging the fines from the material receiving housing; and means for vibrating the material receiving housing and the screens;

each of the screens being generally square shaped and having opposing sides, the screens being supported intermediate the opposing sides to define a centrally disposed elongated ridge, each of the screens being formed such that the ridge divides the screen into two oppositely angled portions with the ridge and the opposing sides being generally parallel, each of the screens being secured to the material receiving housing under substantially uniform tension entirely about the periphery thereof;

the uppermost one of the screens being supported relative to the horizontal such that a force component from the vibrating means provides an outwardly expanding spiral path to particles of the material up and over the elongated ridge as the material traverses the screen so as to approach the overs discharging means;

the lowermost one of the screens being supported relative to the horizontal such that a force component from the vibrating means provides an outwardly expanding spiral path to particles of the material up and over the elongated ridge as the material traverses the screen so as to approach the product discharging means.

14. The material classifying apparatus as defined in claim 13 wherein the overs discharging means and the product discharging means are discharge chutes supported by the material receiving housing.

15. The material classifying apparatus as defined in claim 14 wherein the discharge chutes are disposed on opposite sides of the material receiving housing adjacent one of the opposing sides of each of the screens.

16. The material classifying apparatus defined in claim 13 wherein the fines discharging means is a centrally disposed discharge chute supported by the material receiving housing below the lowermost one of the screens.

17. The material classifying apparatus as defined in claim 13 wherein the vibrating means includes a pair of vibration generators mounted in equal and opposite angular relation on the material receiving housing.

18. The material classifying apparatus as defined in claim 17 wherein the vibration generators are adjustable to vary the rate the overs and product are moved along the spiral paths toward the respective one of the discharging means.

* * * * *